US005192427A

United States Patent [19]

Eger et al.

[11] Patent Number: 5,192,427

[45] Date of Patent: Mar. 9, 1993

[54] SHOWER FILTERS AND ACCESSORIES

[75] Inventors: Douglas R. Eger, 97 Lakeview Village, Montgomery, Tex. 77356; Douglas W. Smith, Robert E. Dawson, both of Ridgefield, Conn.

[73] Assignee: Douglas R. Eger, Montgomery, Tex.

[21] Appl. No.: 528,149

[22] Filed: May 24, 1990

[51] Int. Cl.[5] ..... B01D 27/08

[52] U.S. Cl. ..... 210/133; 210/136; 210/232; 210/238; 210/435; 210/456

[58] Field of Search ..... 4/559, 596, 605, 628, 4/630, DIG. 19; D23/283; 210/136, 232, 433.1, 435, 456, 133, 238

[56] References Cited

U.S. PATENT DOCUMENTS

| | | | |
|---|---|---|---|
| 3,192,950 | 7/1965 | Weese et al. | 4/605 |
| 3,231,200 | 1/1966 | Heald | 4/605 |
| 3,409,230 | 11/1968 | Eelkema | 4/605 |
| 3,926,815 | 12/1975 | McClory . | |
| 4,150,869 | 4/1979 | Hansen | 4/605 |
| 4,212,743 | 7/1980 | Van Meter et al. . | |
| 4,218,013 | 8/1980 | Davison | 4/605 |
| 4,541,131 | 9/1985 | Sussman | 4/596 |
| 4,806,240 | 2/1989 | Giordano et al. | 210/232 |
| 4,880,145 | 11/1989 | McManus | 4/605 |
| 4,933,080 | 6/1990 | Rundzaitis et al. | 4/605 |
| 4,967,935 | 11/1990 | Celest | 4/605 |
| 5,070,553 | 12/1991 | Chambers | 4/605 |

*Primary Examiner*—Robert A. Dawson
*Assistant Examiner*—W. L. Millard
*Attorney, Agent, or Firm*—Browning, Bushman, Anderson & Brookhart

[57] ABSTRACT

A water filter assembly for use with a shower bath comprises a housing containing a filter and a bypass adapter which allows the filter to be displaced, e.g. downwardly, from the direct line leading from the water source to the shower head. The housing is also preferably adapted to hold containers for cosmetics or the like. Several forms of containers, particularly adapted for use in such a holder, are disclosed. Also disclosed are several preferred forms of filter adapted for this use, as well as improved quick disconnect type couplers allowing simultaneous operation of two adjacent such couplers.

49 Claims, 10 Drawing Sheets

FIG. 19
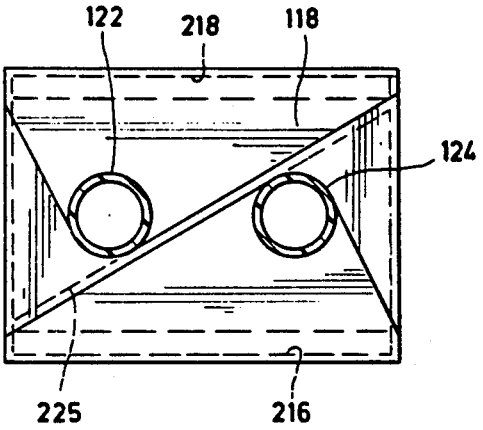
FIG. 18
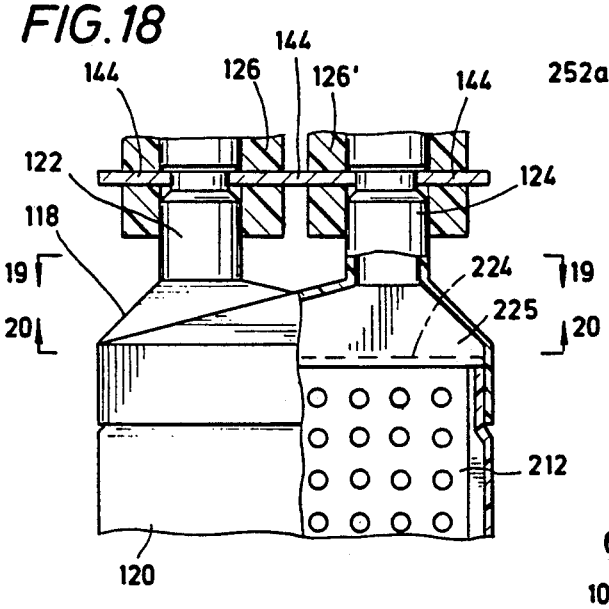
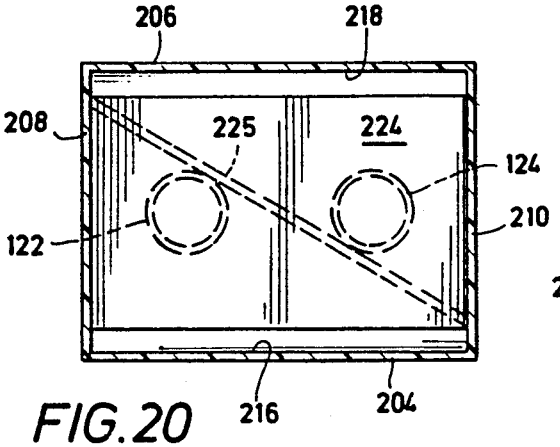
FIG. 20
FIG. 23
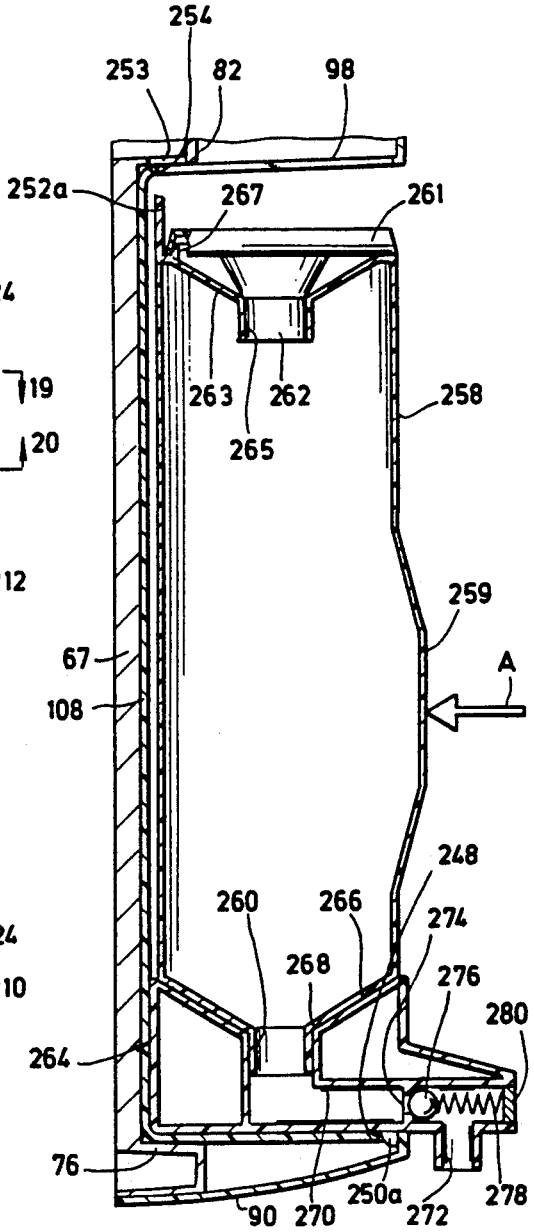

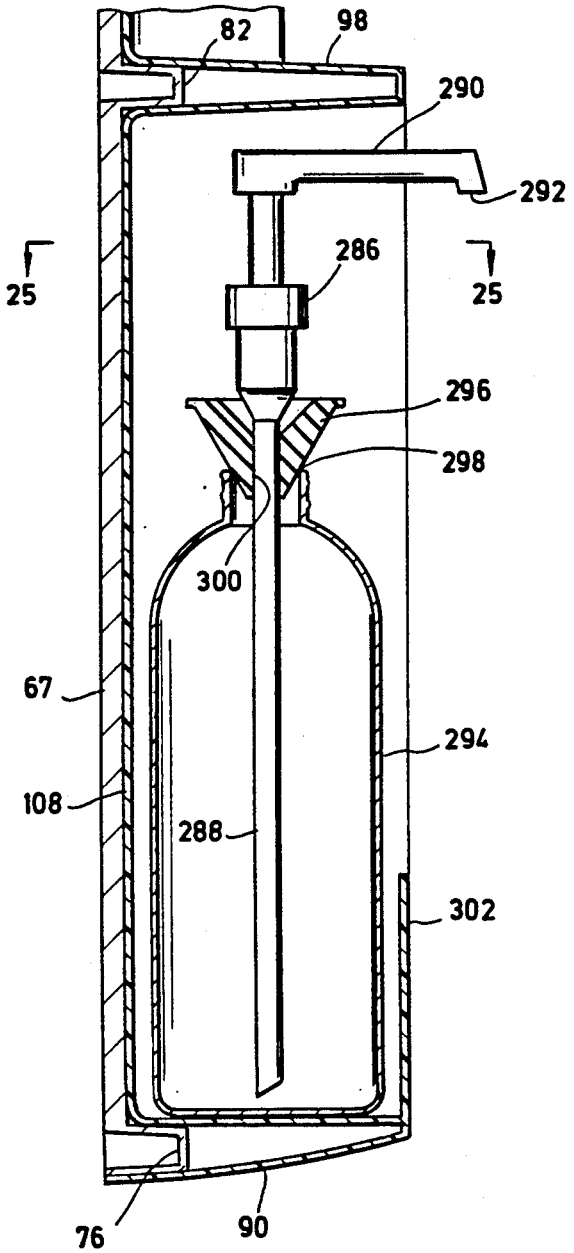
FIG. 24
FIG. 25
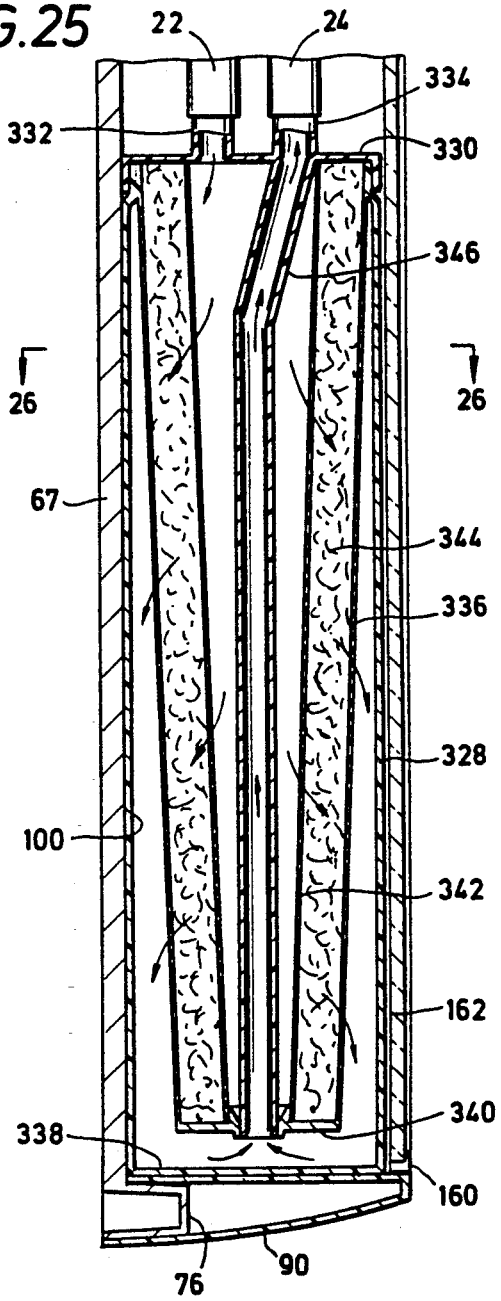
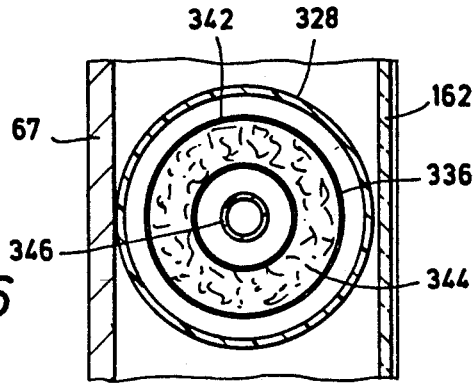
FIG. 26

SHOWER FILTERS AND ACCESSORIES

BACKGROUND OF THE INVENTION

1. Field of the Invention

The present invention pertains to an improved shower accessory. In the most preferred embodiment, the accessory includes a filter, for filtering water before it passes out through the shower head, in combination with several other salient features such as an improved filter case, improved quick disconnect type couplers, improved dispensing containers for cosmetics, and/or improved mounting systems. However, various of these salient features are capable of use independently of one another, and embodiments incorporating such independent usage are also encompassed within this invention.

2. Description of the Background

The benefits of filtering water prior to consumer use are becoming increasingly apparent. While public attention is possibly focused primarily on filtering of water prior to drinking, research has shown that filtering of water prior to contact with the body may be equally important, if not more so. Some research has indicated that certain impurities, notably some chemical contaminants, often present in "potable" water may be absorbed through the skin with particular efficiency while showering.

If the human body or part thereof is immersed in a highly concentrated solution of such chemicals, certain natural defense mechanisms are triggered, whereby the skin reacts in such a way as to resist absorption. However, the concentrations of such contaminants in typical water supplies are very low. Furthermore, the body is not immersed while showering. Thus, it is believed that showering under such conditions does not tend to trigger these defense mechanisms. On the contrary, the skin tends to be warm and relaxed and to absorb very efficiently while showering. Some data suggest that, as to certain types of substances, one five-minute shower per day might subject a person to as much exposure to unwanted contaminants as living with a smoker.

City and other water quality control services are usually limited to ensuring that the water supply does not contain microorganisms likely to cause severe illness, and also to ensure that substantial quantities of highly offensive and/or immediately and severely dangerous chemicals are not present. It is simply not feasible, at least at the current time, for most water quality service entities to attempt to control the presence of every substance, in any quantity, which might have some effect on health upon prolonged exposure.

Home water filtration systems are available which can be installed upstream of the main water inlet into a house, so that all water entering the house is filtered. However, such systems are relatively expensive and can be troublesome to maintain. The consumer may be less likely to go out to a location, typically at the side or the back of the house, to replace the filtering medium, as often as is recommended. Yet with such a filter treating all the water entering the house, it is particularly important that the filtering medium be changed frequently enough. Otherwise, not only will the filtering medium become "spent," in the sense that it cannot adsorb any more impurities, but microbial growth within the filtering medium can replace one health problem with another, and possibly worse.

Water filters are also available for installation in individual water taps. These are usually used in connection with kitchen taps, because of the aforementioned public attention on drinking water, as opposed to bathing water. It is, of course, possible to devise such a filter for installation just upstream of a shower head. At least one such filter has been devised and sold under the name "Rainshower." This device was in the form of a large disc. Positioning of the filter directly in line with the shower head makes the filter particularly inconvenient to service because of the necessary height of the shower head. Since people tend to avoid doing that which is inconvenient, once again there is the danger that the consumer will not change the filtering medium often enough, which can present a worse problem than that the filter was originally intended to solve. Further consumer resistance to the use of such a direct in-line filter is generated by the necessary size of the filter which, when positioned near the shower head, is considered unaesthetic.

There is also room for improvement in various ancillary devices, such as connectors and dispensing containers, which ca be incorporated with a shower filter to enhance it.

SUMMARY OF THE INVENTION

The present invention provides a water filter assembly which is particularly well adapted for use with a shower bath.

The assembly includes housing means having an inlet and an outlet, and filter means mounted in the housing means in communication with the inlet and the outlet so that water flowing into the housing means through the inlet will pass through the filter means and out the outlet. A bypass adapter allows the housing means to be mounted in a position substantially displaced from the incoming water source pipe and the shower head, more specifically, to be spaced downwardly from the pipe and shower head. This places the housing means within ready reach of the user, so that it is easy to replace the filtering medium. It also allows the housing means to carry other salient features, which is not only advantageous in itself, but also disguises the filter as a more familiar looking accessory, thereby eliminating consumer resistance based on aesthetics.

For example, the housing means may also incorporate a holder portion for holding containers of cosmetics or the like, and the containers themsleves may be improved for easy dispensing and refilling. Several improved forms of such containers and means of associating them with the housing, which make them especially easy to use, refill, and generally maintain, are also disclosed. Likewise, the housing may also carry a mirror over the filter itself, so that the filter is hidden and warm water passing through the filter will prevent "fogging" of the mirror so that it can be used while showering.

Other aspects of the preferred embodiment further enhance the ease of servicing the filter. For example, the housing means may comprise a main or outer housing and a filter case removably disposed in a suitable filter compartment defined by the main housing. Thus, only the filter case need be removed to replace the filtering medium, either by changing the medium in the case or by disposing and replacing the entire case, the remainder of the housing remaining in place. This in turn also makes it more feasible to incorporate a cosmetic container holder, as described above.

Preferred filter cases provide small annular inlets and outlets, side by side, but define transition paths to intake and outflow surfaces, respectively, of the filtering medium, those surfaces having much greater surface area than the transverse cross-sectional flow areas of the inlet and outlet. This allows the maintenance of an adequate flow rate without an unacceptably large pressure drop across the filter.

Improved quick disconnect type coupling means are provided which enhance the ease with which disconnection and connection can be accomplished, simultaneously, at both the inlet and the outlet for purposes of replacing the filtering medium.

All of this encourages the consumer to use and properly maintain the filter assembly, partly because of the enhanced convenience of servicing, partly because of better aesthetics, and also because the consumer does not have to choose between a filter and other accessories, such as a cosmetic holder or a heated mirror; the filter not only does not interfere with such other accessories, but the preferred assembly incorporates and improves upon them.

Various objects, features and advantages of the invention will be made apparent by the following description, the drawings and the claims.

BRIEF DESCRIPTION OF THE DRAWINGS

FIG. 18 is an enlarged detailed view of the upper part of the filter case with parts broken away.

FIG. 19 is a view taken on the line 19—19 of FIG. 18.

FIG. 20 is a view taken on the line 20—20 of FIG. 18.

FIG. 23 is a view similar to that of FIG. 22 showing a different form of cosmetic container and related modifications in the housing.

FIG. 24 is a view similar to that of FIG. 22 showing still another embodiment of cosmetic container and related housing modifications.

FIG. 25 is a view similar to that of FIG. 21 showing another embodiment of filter and filter case.

FIG. 26 is a view taken on the line 26—26 of FIG. 25.

DETAILED DESCRIPTION

Figure 1:
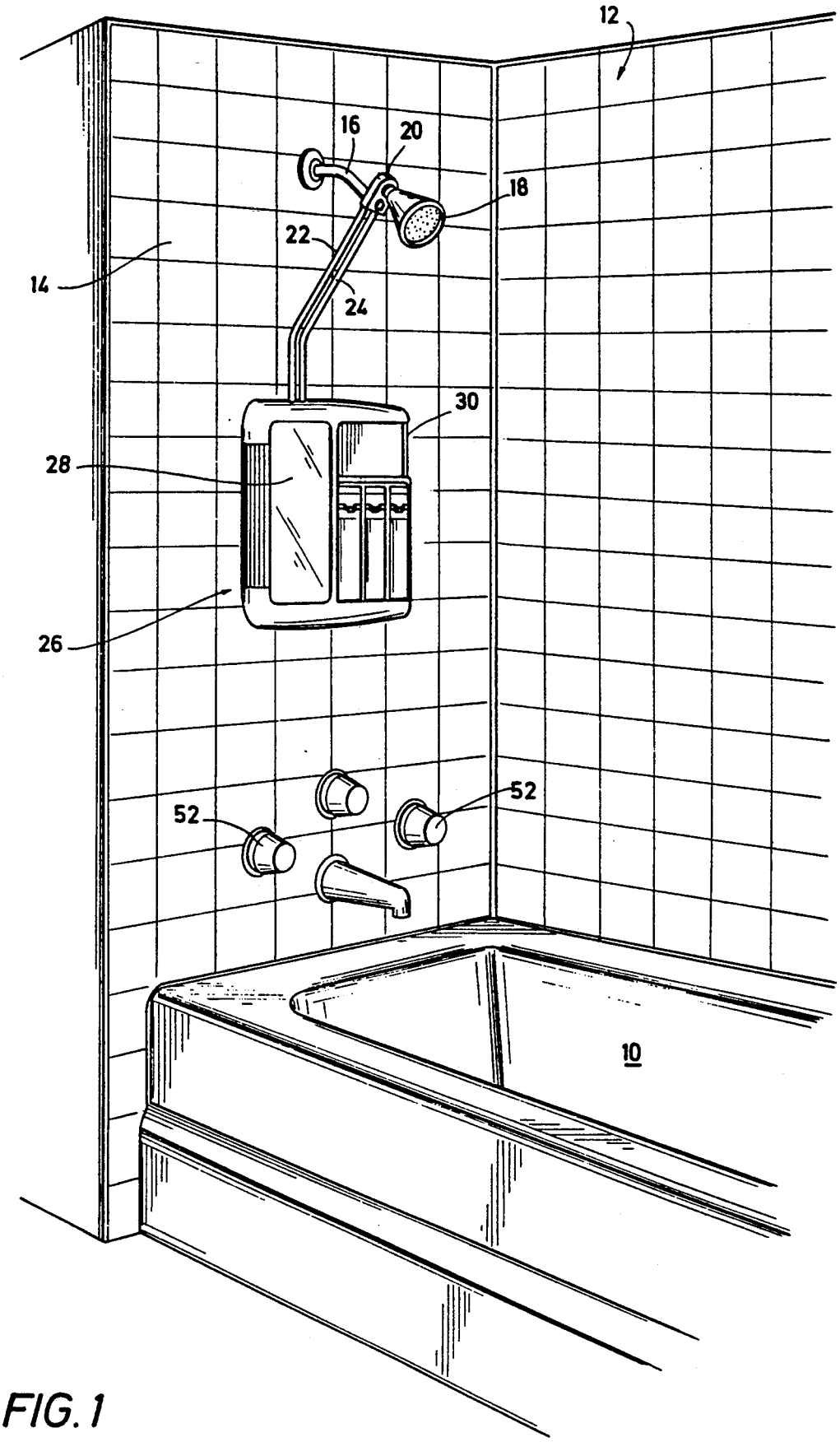
FIG. 1 is an environmental view showing a shower accessory according to the present invention in place in a shower bath stall.

FIG. 1 illustrates a bath including a tub 10 within a stall 12 having a wall 14 which will be defined as the "rear" wall for purposes of this specification. Terms such as "rear," "front," "forward," "upper," and "lower" are used herein for convenience in describing apparatus oriented as shown, and should not be construed to unduly limit the scope of the invention.

Extending outwardly into the stall 12 from the rear wall 14 is pipe 16 representing a water source. A shower head 18 is connected to the outer or downstream end of pipe 16 by means of a bypass adapter 20, to be described more fully below. Inlet and outlet lines 22 and 24, respectively, extend from the bypass adapter 20 to the housing means 26. As shown, housing means 26 is displaced below pipe 16, head 18 and adapter 20 so that it is at a convenient level for a user taking a shower bath in the stall 12. Although, in some embodiments of the invention, the housing means 26 could be suspended on lines 22 and 24, in the preferred embodiment shown, housing means 26 is supported on the rear wall 14 of the shower stall, in a manner to be described more fully below. Housing means 26 generally defines, on its left-hand side as faced by the user, a mirrored door 28 leading to a filter compartment, and on its right-hand side, a holder portion 30 for holding containers of cosmetics and other items.

Referring now to FIGS. 2-6, the bypass adapter 20 includes a rigid body 32 having two main internal passages. A first, upstream, such passage has a front-to-rear section 34 extending into the rear surface 36 of the body 32 and forwardly, and defining a source port 35 into which is threaded the water source pipe 16. Inwardly of source port 35, the first passage has a laterally extending section 44, extending left to right from section 34 (as viewed from the front), which in turn intersects a downwardly extending section 46 which opens through the bottom of body 32 to define an upstream bypass port 47 to which is threadedly connected the inlet line 2 (compare FIG. 1).

The second, downstream, passage has a front-to-rear section 38 extending into the forward surface 40 of body 32 and rearwardly, defining a head port 39 into which is threaded a pipe 42 which is communicatively connected, in a conventional manner, to the shower head 18. Inwardly of head port 39, the second passage has a section 48 extending laterally from left to right from section 38, and section 48 in turn intersects a downwardly extending section 50 which opens through the bottom of body 32 thereby defining a downstream bypass port 51 into which is threadedly connected the end of the outlet line 24.

Thus, water from source pipe 16 can pass through first passage 34, 44 and 46 and inlet line 22 into the inlet of a filter case of housing 26 (to be described below), through a filtering medium, up through an outlet in the filter case, through outlet line 24, second passage 50, 48, and 38, and finally out through shower head 18. Thus, the bypass adapter allows the water to be passed through a filter before emerging from the shower head 18, but allows that filter to be displaced well below pipe 16 and shower head 18.

In some instances, it may be desired to disconnect the filter from the water flow course, so that water can pass directly from pipe 16 through shower head 18 without passing through the filter, or it may be desired to be able to completely shut off flow from pipe 16 by a control located near the shower head 18, as opposed to the faucet controls 52 (see FIG. 1). Accordingly, section 34 of the first passage is caused to intersect section 50 of the second passage, and in this intersecting area of section 34, downstream of source port 35, there is disposed a bypass valve element 54.

Valve element 54 is generally cylindrical and is concentrically mounted in section 34 for rotation about its own axis, which lies lengthwise along section 34. Element 54 is hollow, the interior thereof opening through the rear end of the valve element as shown at 56 so that water from pipe 16 can enter the interior of the valve element through section 34. Valve element 54 also has a radial port 58 whose position can be altered by rotation of the valve element 54. Valve element 54 is sealed with respect to body 32 by O-rings 60 located on opposite sides of port 58.

A reduced diameter continuation 33 of the bore which forms section 34 opens outwardly through the forward surface 40 of body 32. A valve stem or neck 62, integral with valve element 54, extends through continuation 33 of section 34 to the exterior of body 32, and is suitably connected to an actuator in the form of a knob 64.

Figure 3:
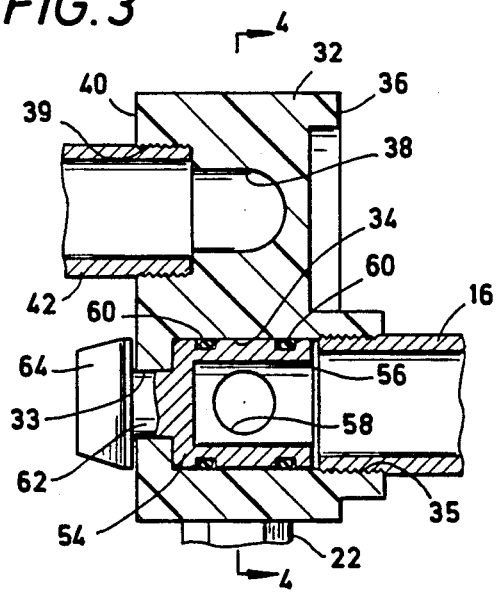
FIG. 3 is a cross-sectional view taken on the line 3—3 of FIG. 2.
Figure 4:
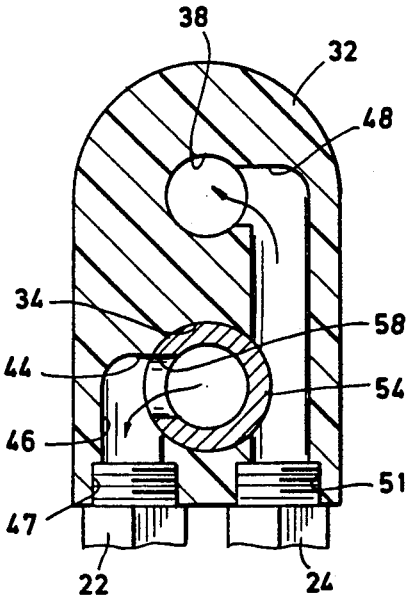
FIG. 4 is a cross-sectional view taken on the line 4—4 of FIG. 3 showing the bypass valve in a first position.

FIGS. 3 and 4 show the valve element in a first or "bypass" position wherein port 58 is aligned with section 44 of the first passage so that the first passage is open, the valve element 54 essentially forming a part of that first passage, and the unported portion of valve element 54 is blocking communication between sections 34 and 50 of the first and second passages, respectively. Thus, water is prevented from bypassing the filter, and rather must flow along the course previously described through the filter before exiting the shower head 18.

Figure 2:
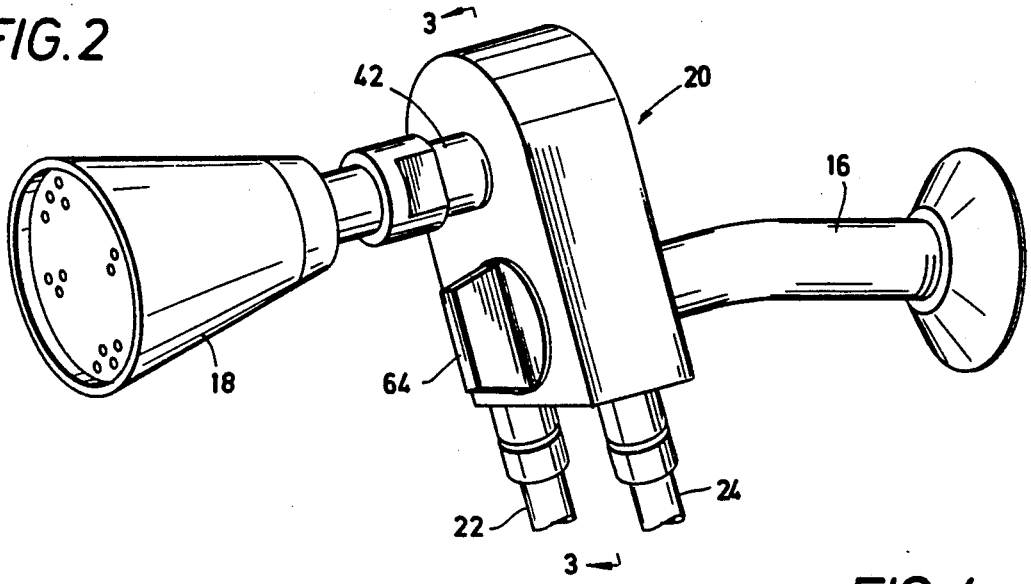
FIG. 2 is an enlarged perspective view of the bypass adapter, water source pipe and shower head.
Figure 5:
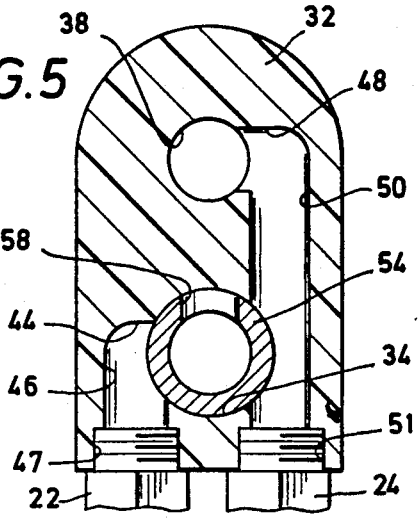
FIG. 5 is a view similar to FIG. 4 showing the bypass valve in a second position.

By rotating the knob 64, and the attached valve element 54, 90° clockwise from the first position of FIGS. 2–4 to a second or "off" position, shown in FIG. 5, port 58 is displaced from communication with any of the internal passages of the body 32, while the remainder of valve element 54 blocks all communication between sections 34 and 50, thereby blocking communication between the first (upstream) and second (downstream) passages. Thus, communication between pipe 60 and shower head 18 is completely shut off.

Figure 6:
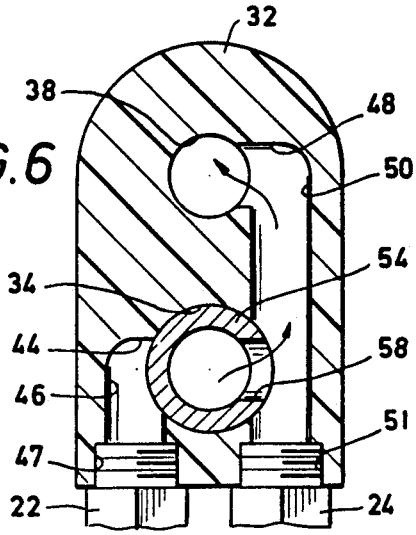
FIG. 6 is a view similar to that of FIG. 4 showing the bypass valve in a third position.

By rotating knob 64 and the attached valve element 54 another 90° in the clockwise direction, to a third or "direct communication" position shown in FIG. 6, port 58 is brought into alignment with section 50 of the second passage, while the first passage 34, 44, 46 is blocked, i.e. source port 35 is blocked from communication with upstream bypass port 47. Thus, in the third position of the valve element 54 as shown in FIG. 6, water can bypass the filter by flowing directly from the first passage to the second. The water flows through pipe 16 into the interior of valve element 54 through port 58, and sections 50, 48 and 38, through shower head 18.

Figure 7:
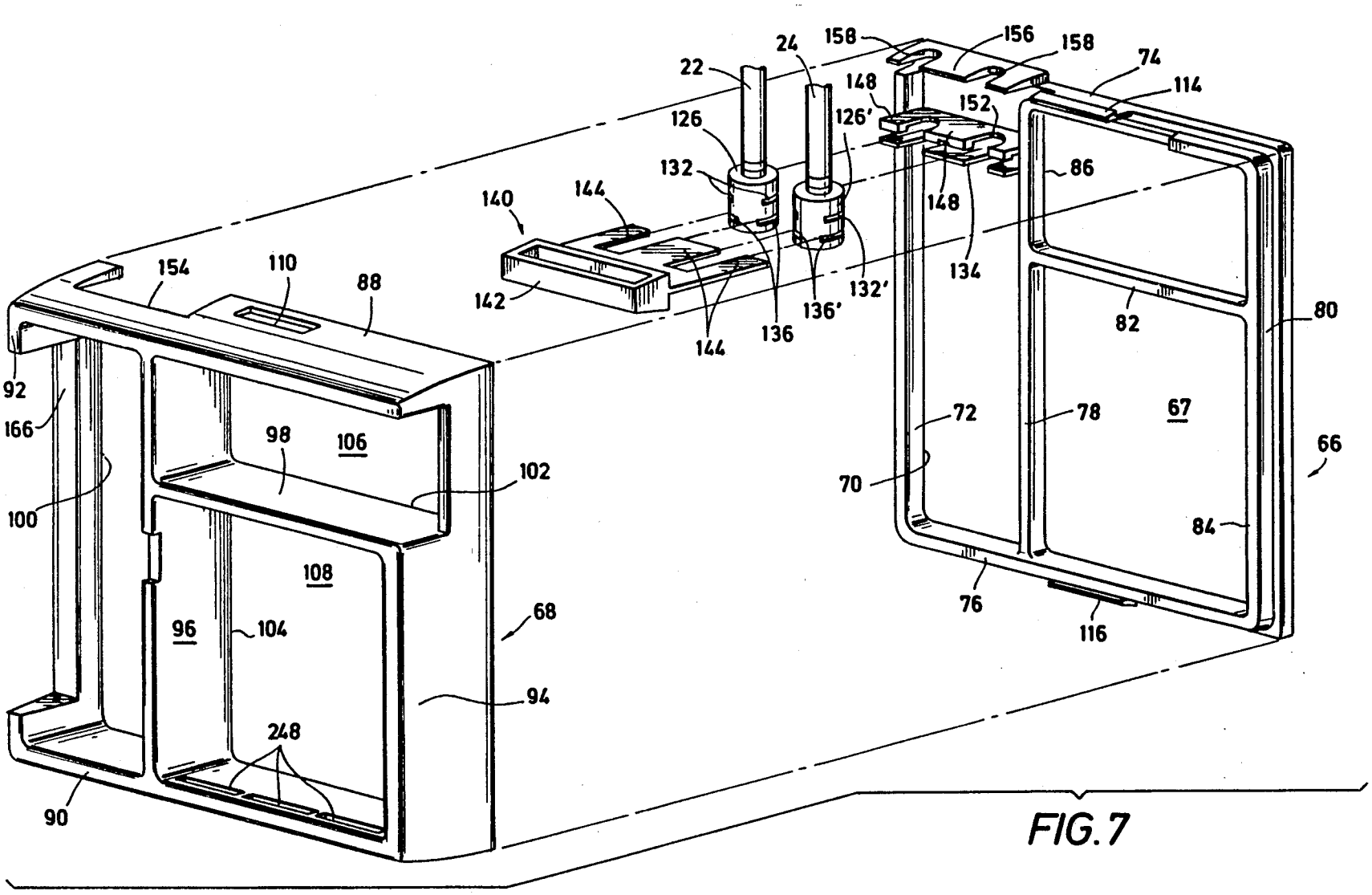
FIG. 7 is an exploded perspective view of the front and rear portions of the main housing and the quick disconnect couplers.
Figure 8:
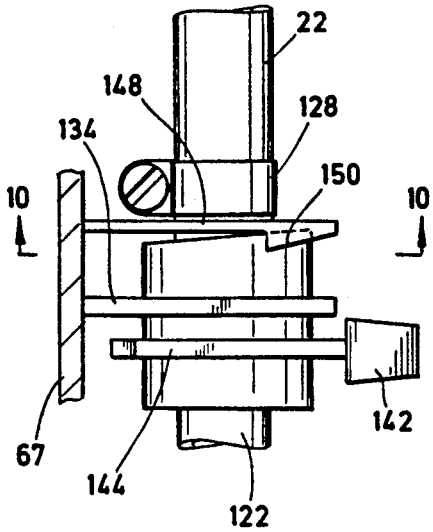
FIG. 8 is an enlarged side view of one of the quick disconnect couplers and associated parts of the housing.

Referring now to FIG. 7, the housing means 26 comprises a main or outer housing including a rear portion 66 and a front portion 68. The housing means 26 also comprises additional parts, to be described below, but these have been omitted from FIG. 7 for clarity of illustration of the parts in question.

Rear portion 66 is in the form of a base adapted to be mounted on the rear wall 14 of the shower stall 12 by means of conventional pressure sensitive adhesive pads, well known in the art, or by screws or the like. The base 66 is generally rectangular in form, and has forwardly projecting strips which subdivide it so as to frame three distinct rectangular areas, each of which is closed at the rear by wall 67. The first such area 70 is on the left, and extends the full vertical height of framework 66. It is defined by the left-hand outer strip 72, left-hand portions of the upper and lower strips 74 and 76, respectively, and the internal vertical strip 78. Area 70 forms a part of the filter compartment to be further described below.

The framework further defines lower right-hand area 84 between lower portions of internal vertical strip 78 and right-hand strip 80, and between the right-hand portion of lower strip 76 and an internal horizontal strip 82 extending between strips 78 and 80. Above strip 82, and further defined by upper portions of strips 78 and 80 and a right-hand portion of strip 74 is an upper right-hand area 86.

The front portion 68 of the housing is removably attachable to the rear portion of framework 66 by means to be described. Front portion 68 has a plurality of front-to-rear walls generally registering with the various strips of the framework 66 and providing the bulk of the front-to-rear depth of the housing. These are double walls, defining hollow spaces opening rearwardly to receive the registering strips of rear portion 66 (see e.g. FIGS. 21 and 22). More specifically, front portion 68 includes an upper wall 88, a lower wall 90, a left-hand wall 92, which is cut out at 166 to receive a door to be described below, a right-hand wall 94, an interior vertical wall 96, and an interior horizontal wall 98, which walls register with strips 74, 76, 72, 80, 78, and 82, respectively, when the front and rear portions of the main housing are assembled.

Thus, front housing portion 68 defines three compartments 100, 102 and 104, corresponding to areas 70, 86 and 84, respectively. Compartment 100 is a filter compartment, and is open through the rear of front housing portion 68. Compartments 102 and 104 jointly form a holder portion of the housing, and are closed by transverse rear walls 106 and 108 of front housing portion 68.

Figure 22:
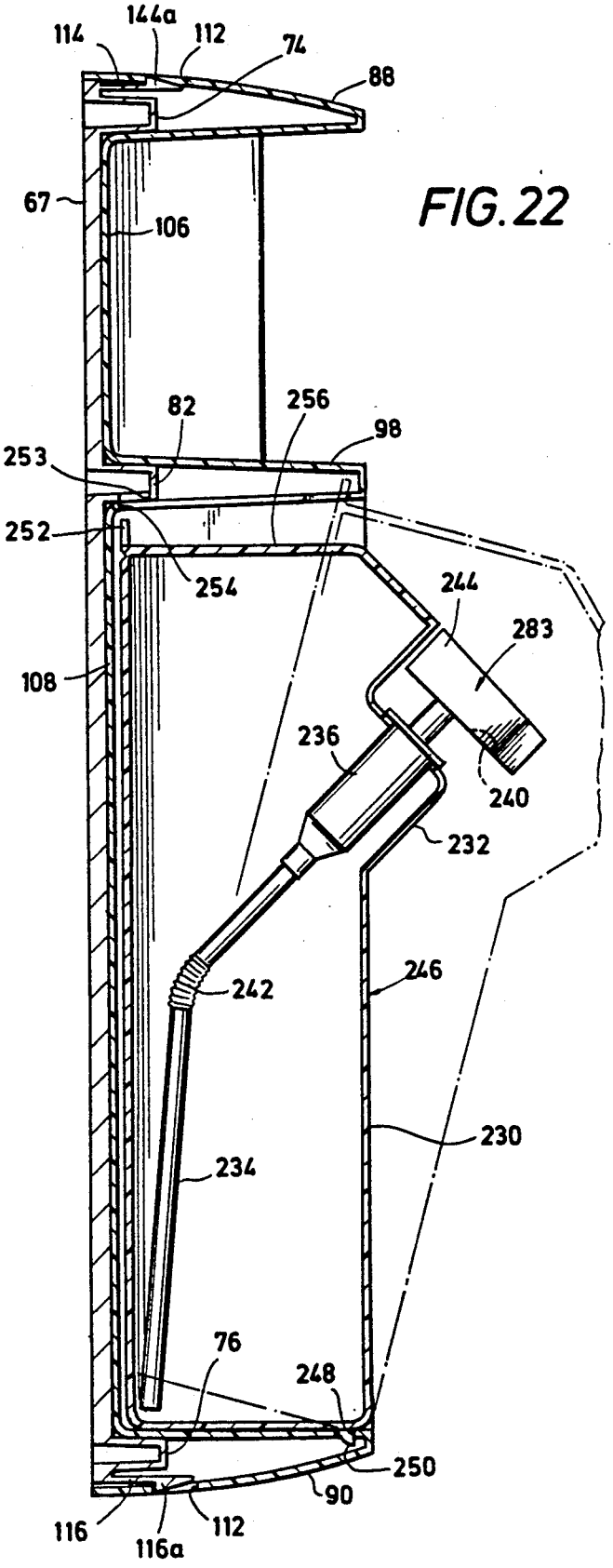
FIG. 22 is a cross-sectional view through one of the cosmetic containers and associated parts of the housing taken on the line 22—22 of FIG. 16.

Referring now jointly to FIGS. 7 and 22, it can be seen that there is a cutout 110 in the upper run of upper wall 88 and a similar cutout 112 in the lower run of lower wall 90. Upper strip 74 of rear housing portion 66 carries a flexible tab 114 which projects in a forward direction and can flex along its rear edge. A catch formation 114*a* projects upwardly on tab 114 and has a sloping forward surface and an abrupt, substantially vertical rear surface. Tab 114 is positioned to align with cutout 110. When the front portion 68 of the housing is pushed rearwardly against rear housing portion 66, the edge of the upper run of wall 88 will move along the inclined forward surface of projection 114*a*, which acts like a cam, so that tab 114 is flexed downwardly until it can snap into cutout 110, whereafter the vertical rear surface of projection 114*a* abuts the rear edge of cutout 110, as shown in FIG. 20, to prevent withdrawal until the tab 114 is forcibly flexed downwardly by the user's fingers.

The lower strip 76 of the rear housing portion 66 is provided with a similar tab 116, a mirror image of tab 114, including a downward projection 116*a* having an inclined forward surface and a vertical rear surface. Projection 116*a* engages in the cutout 112 in the same manner that projection 114*a* engages in cutout 110. Together, the tabs 114 and 116 retain the front portion 68 of the housing on the rear portion 66 until released in the manner described above.

This embodiment of the invention further includes a removable filter case which, for purposes of this specification, is considered a part of the housing means. It is more convenient to provide a high pressure seal between lines 22 and 24 and such a small removable case than between the lines 22 and 24 and the main housing 66, 68. The filter case, which is shown in FIGS. 16–21, is received in the filter compartment 100 and includes an upper cover 118 removably fitted over the upper rim of a main body portion 120. Cover 118 includes a pair of upstanding tubular formations 122 and 124, disposed laterally side-by-side and defining the inlet and outlet, respectively, for the filter case 118, 120, and thus for the housing means.

Quick disconnect couplers, shown in FIGS. 7–10, 16 and 21, are provided for coupling projections 122 and 124, respectively, to the lines 22 and 24 from the bypass adapter 20, and the front and rear portions 66 and 68 of the housing are specially adapted to accommodate and assist in the operation of these quick disconnect couplers.

Figure 9:
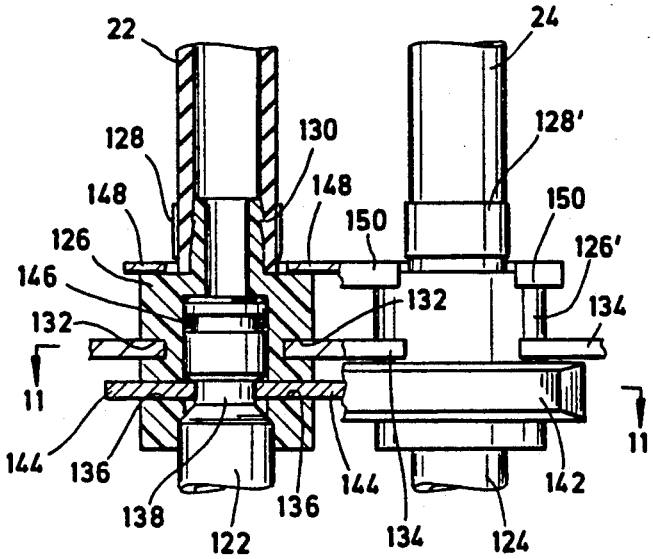
FIG. 9 is a front view of both quick disconnect couplers, with one coupler being shown partially in longitudinal cross section.
Figure 11:
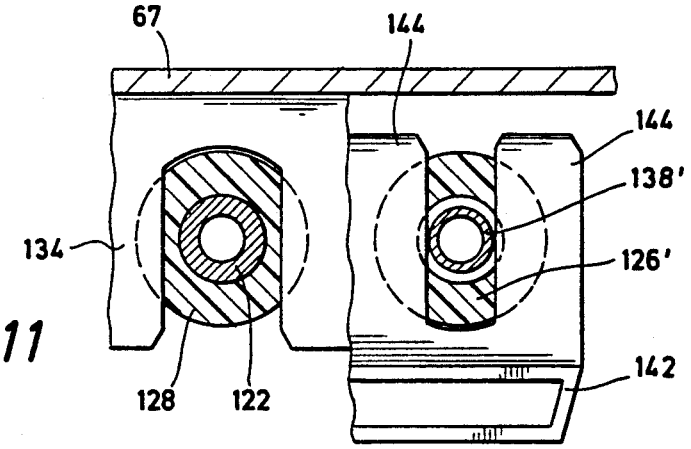
FIG. 11 is a view taken along the line 11—11 of FIG. 9.
Figure 10:
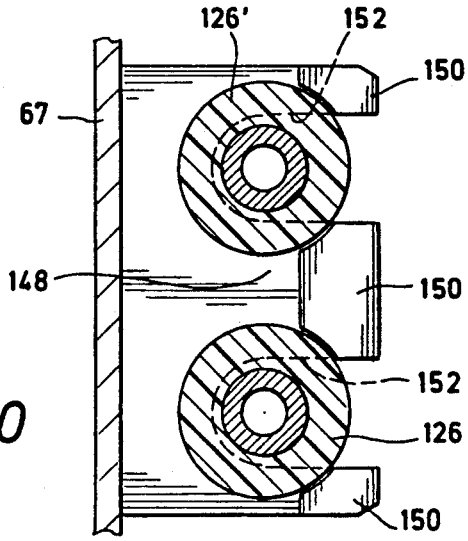
FIG. 10 is a view taken along the line 10—10 of FIG. 8.

The left-hand side of FIG. 9 shows a longitudinal cross-sectional view through one of the quick disconnect couplers, specifically the one connecting line 22 and formation 122, and it should be understood that the coupler on the right-hand side of FIG. 9, which connects line 24 and formation 124, is identical in construction.

The upper portion of formation 122 forms the inner annular body of the coupler. This inner body is, in the connected position shown, received within an outer annular body 126 which is connected to the lower end of line 22 by a clamp 128, assisted by tooth-like formations 130 cooperative between body 126 and line 22 to frictionally resist removal of body 126 from line 22.

The portion of body 126 which receives inner body 122 is of enlarged diameter, as shown. Thus, it can accommodate two sets of grooves. A first pair of grooves 132 extend generally tangentially through opposite lateral sides of body 126 in the front-to-rear direction. These grooves have a radial depth which stops short of intersection with the central longitudinal bore of body 126. Grooves 132 receive the edges of horizontal flanges 134 which are rigidly carried by the rear wall 67 of housing portion 66 and project forwardly into the filter compartment 100. For convenience, flanges 134 can be formed by a single horizontal member having cutouts opening through its forward edge for receipt of the couplers. Flanges 134 support and vertically position the body 126, as well as the analogous body 126' of the right-hand coupler, with respect to the housing.

Below grooves 132, body 126 has a second pair of similar grooves 136, likewise extending generally tangentially along opposite lateral sides of the body in the front-to-rear direction, but deep enough to intersect the central longitudinal bore of body 126. When the inner body 122 is fully seated in the outer body 126, a necked down area 138 thereof is aligned with grooves 136. A retainer key 140, having a forwardmost handle 142 and rearwardly extending horizontal tabs 144, is used as a common detent means for both of the couplers. When the key 140 is properly aligned and urged rearwardly, the left-hand tab 144 will slide into the left-hand groove 136 of the left-hand coupler, the left-hand edge of the central tab will slide into the right-hand groove 136 of the left-hand coupler, while its right-hand edge will slide into the mirror image left-hand groove 136' of the right-hand coupler, and the right-hand edge of the far right tab 144 will slide into the right-hand groove 136' on the right-hand coupler. The width of the tabs 144 is such that they extend past the grooves 136 and 136' into the respective necked down areas, e.g. 138, of the inner bodies, e.g. 122, of the couplers to retain those inner bodies in proper position in the outer bodies 126, 126'. Upwardly of necked down area 138, inner body 122 has an annular groove carrying an O-ring 146 which seals against the inner surface of outer body 126. This is the aforementioned high pressure seal.

A second set of flanges 148, conveniently formed on a single horizontal plate, project forwardly from the rear wall 67 of housing portion 66 above flanges 134. These flanges 148 are positioned to overlie the upper surfaces of the enlarged portions of bodies 126 and 126'. Adjacent the free edges of the flanges 148 are thickened hook-like formations 150. The cutouts 152 in the horizontal plate, which divide that plate into the three individual flanges 148, closely receive the smaller diameter upper portions of the bodies 126 and 126', and thus the edges of the flanges 148 project laterally inwardly in overlapping relation to the enlarged portions of the bodies 126 and 126'. The hook-like formations 150 project downwardly over portions of the forward surfaces of the enlarged portions of bodies 126 and 126', in like laterally overlapping relation, and this prevents bodies 126 and 126' from being displaced forwardly, e.g. when key 140 is removed.

To allow the lines 22 and 24 to pass into the filter compartment, the upper wall 88 of the forward housing portion 68 has a rearwardly opening cutout 154 which receives a forwardly projecting flange 156 at the top of the left rear of housing portion 66. Flange 156 has cutouts 158, opening forwardly, to accommodate lines 22 and 24.

Figure 16:
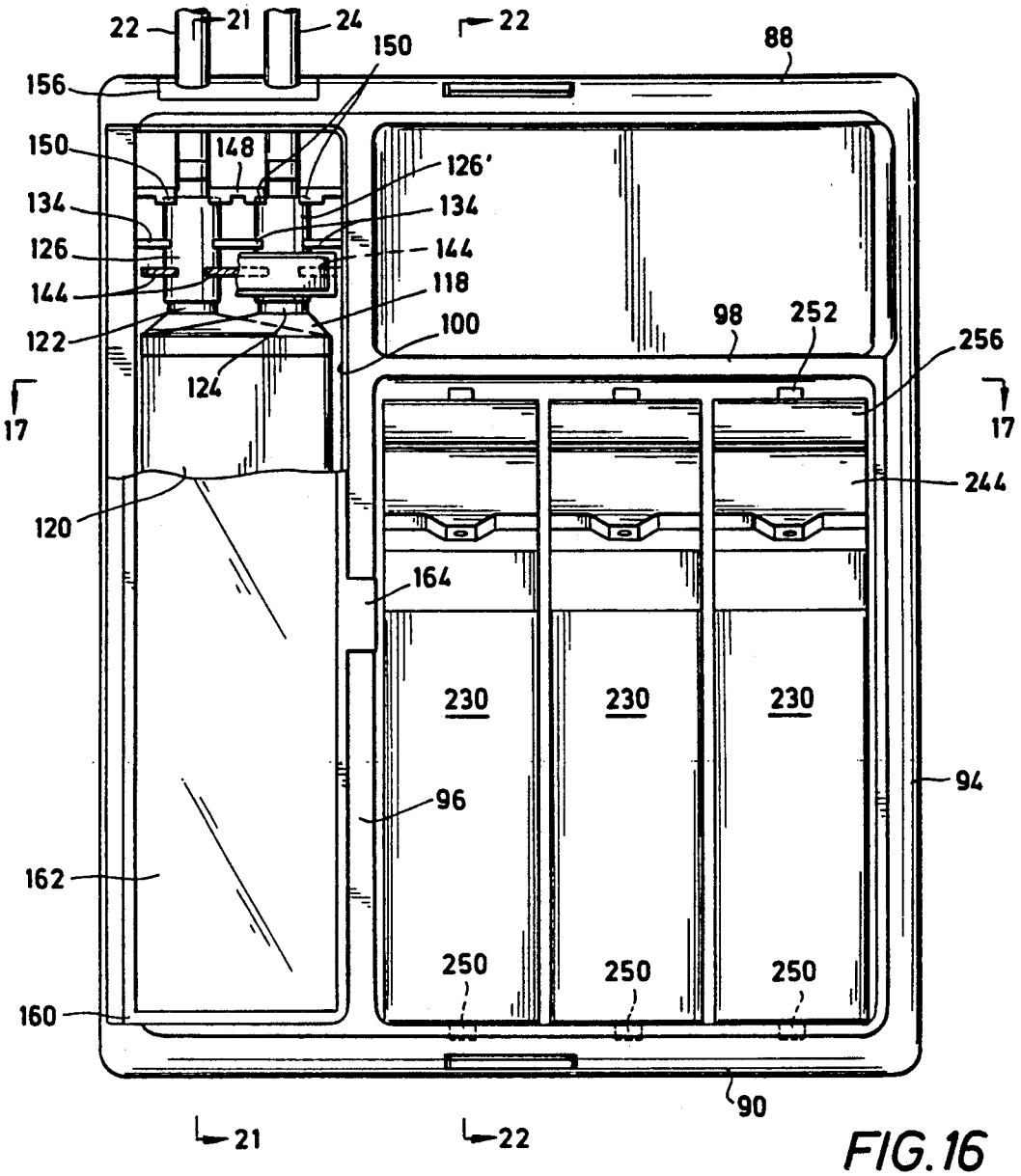
FIG. 16 is a front elevation view of the housing, with part broken away to show the upper portion of the filter and the quick disconnect couplers.

Referring to FIG. 16, it will be seen that a door 160 is pivoted on its left-hand side into a cutaway area 166 in left side wall 92 of the forward housing portion 68 (see also FIG. 7). This door, which has a latch 164 for releasably retaining it in a closed position, is the door of the filter compartment 100. The door carries an exterior mirror 162. Because this mirror will be disposed closely adjacent the filter in use, and because warm water will be passing through the filter, the mirror will be prevented from fogging.

When it is desired to remove the filter case 118, 120 from the filter compartment 100 to change the filtering medium, the door 160 is opened, and the key 140 is grasped by its handle 142 and pulled forwardly. This removal of a common detent simultaneously releases both of the quick disconnect couplers. Then, since the inner bodies 122 and 124 of those couplers are commonly carried on the cover 118 of the filter case, it is only necessary to move the filter case downwardly and out through the front of the filter compartment. When it is time to replace the filter case, the same sequence of operations is reversed.

As previously mentioned, the right-hand quick disconnect coupler is identical to the left-hand quick disconnect coupler, and, to the extent not otherwise set forth, parts of the right-hand coupler have been given the same reference numerals as the identical parts of the left-hand coupler, but with the addition of the suffix prime (').

Before proceeding to a more detailed discussion of the filter case, reference is made to FIGS. 12–15, which show how the housing means can be modified to utilize and cooperate with a more conventional ball detent type quick disconnect coupler. Once again, in FIG. 13, the left-hand quick disconnect coupler is shown in longitudinal cross section, and it should be understood that the right-hand coupler is identical. Those parts of the right-hand coupler which are shown are designated by the same reference numerals as the like parts of the left-hand coupler, but with the suffix prime (').

The filter case has a cover, designated 118*a* in this embodiment, which commonly carries upstanding tubular formations 122*a* and 124*a* defining the inlet and outlet, respectively, of the filter case, and also forming the inner bodies of the respective quick disconnect couplers. Each coupler also has an outer annular body 166 or 166', which, as in the first embodiment, is connected to a respective one of the lines 22 or 24 by a clamp 168 or 168'. These connections are made through holes, one of which is shown at 170, in a horizontal plate 172 extending forwardly from the rear wall of housing portion 66 so that the line 22 and body 166 are restrained against front-to-rear and lateral movements.

Figure 13:
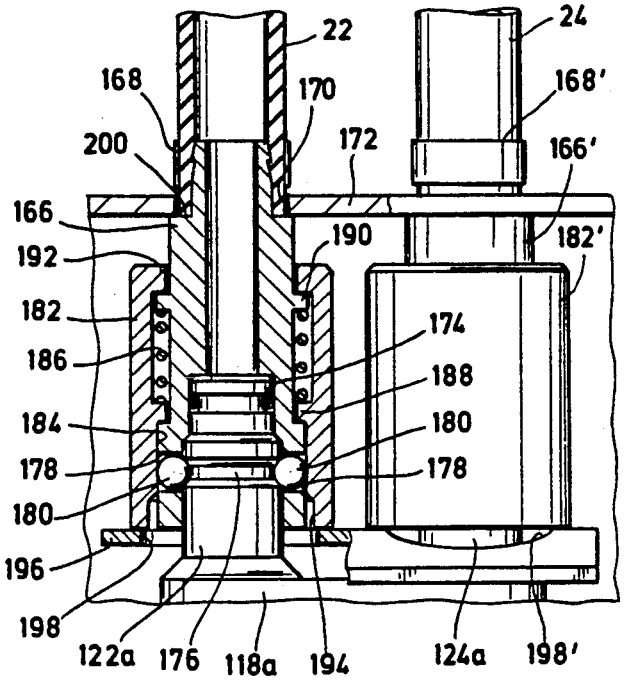
FIG. 13 is a view similar to that of FIG. 9 showing the quick disconnect coupler embodiment of FIG. 12.

In the coupled position, as shown in FIG. 13, inner body 122*a* is received in outer body 166. An O-ring 174 carried in a groove near the free end of body 122*a* provides a high pressure seal against the interior wall of body 166.

Body 122*a* has a larger annular groove 176 which, in the coupled position, is aligned with an annular array of circumferentially spaced radial bores 178 through body 166. Each bore 178 contains a detent ball 180 whose diameter is greater than the thickness of the adjacent portion of body 166, i.e. the length of bore 178. A retainer sleeve 182 is telescopically mounted on body 166. Sleeve 182 has a small inner diameter section 184 which, in the coupled configuration of FIG. 13, is overlying bores 178. Section 184 has a sliding fit on the portion of body 166 adjacent ports 178. Thus, sleeve 182 retains balls 180 in radially inner positions, wherein they protrude radially inwardly from bores 178 and into the aligned grooves 176 in the inner body, thus retaining the inner body in the outer body 166.

Sleeve 182 is yieldably held in this position by a compression spring 186 acting between radial flanges 188 and 190 on the sleeve 182 and body 186, respectively. This urges sleeve 182 downwardly with respect to body 166, downward movement being limited by abutment of an inturned stop flange 192 on sleeve 182 with the top of flange 190 on body 166. Below small diameter section 184, sleeve 182 has an enlarged inner diameter section 194. It can be seen that, if sleeve 182 is raised with respect to body 166, compressing spring 186, so that section 194 comes into alignment with balls 180, the latter can move radially outwardly, and out of engagement with groove 176, so that inner body 122*a* can be removed from outer body 166.

Figure 12:
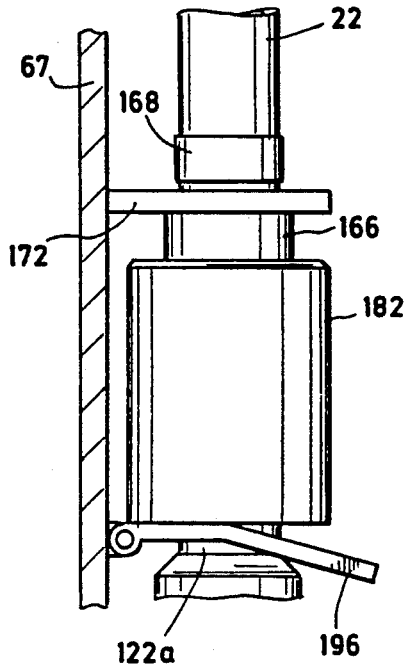
FIG. 12 is a view similar to that of FIG. 8 showing a different form of quick disconnect coupler and related modifications in the housing.
Figure 14:
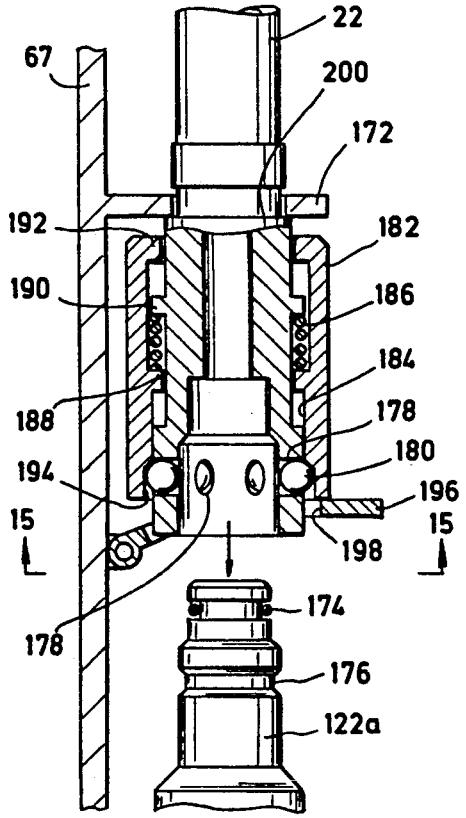
FIG. 14 is a view similar to that of FIG. 12 showing the coupler in a disconnected mode and with certain parts in longitudinal cross section.
Figure 15:
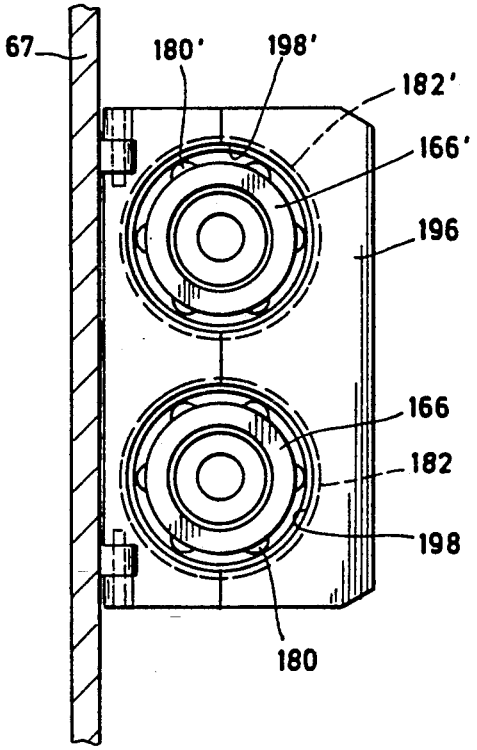
FIG. 15 is a view taken on the line 15—15 of FIG. 14.

This movement can be accomplished simultaneously for both of the quick disconnect couplers by means of a release lever 196 in the form of a generally horizontal plate pivotally connected to rear wall 67 of housing portion 66 for vertical movement. Limits are placed on this vertical movement by any suitable means, as would be appreciated by one of skill in the art. The lowermost position of lever 196 is shown in FIGS. 12 and 13. Lever 196 has two apertures 198 and 198', for receiving respective bodies 122*a* and 124*a*. The apertures 198 and 198' are small enough so that the lower edges of the sleeves 182 and 182' can rest on the lever 196, thus supporting both couplers on that lever, but small enough to clear bodies 166 and 166'. Body 166 cannot move upwardly because of abutment of a shoulder 200 thereon with the underside of flange 172. Thus, if lever 196 is pivoted from its lower position (FIGS. 12 and 13) to its upper portion as shown in FIG. 14, sleeves 182 and 182' will be urged upwardly with respect to their respective bodies 166 and 166', to the release position illustrated in FIG. 14, wherein the large diameter section 194 is aligned with balls 180. Pulling downwardly on the filter case will cause the inclined upper surface of groove 176 to cam balls 180 radially outwardly to the positions shown in FIG. 14, so that the inner bodies 122*a* and 124*a* can be simultaneously removed by moving the filter case down.

Referring now to FIGS. 16–21, the filter case and filtering medium will be described in greater detail. The main body 120 of the filter case is generally elongate in the vertical direction and rectangular in transverse cross section, having a bottom wall 202 and four lateral walls including the front and rear walls 204 and 206, respectively, and left and right side walls 208 and 210. Upstanding from bottom wall 202 are a pair of porous baffles 212 and 214. The baffles 212 and 214 are parallel to, and spaced inwardly from, respective lateral walls 204 and 206 so as to define respective front and rear lateral spaces 216 and 218. The baffles are mounted in the filter case by having their side edges slidably disposed in slots in bosses 220 molded integrally with the main body 120.

Baffles 214 and 212 contain the filtering medium 222 therebetween, and define respective intake and outflow surfaces of relatively large surface area. By providing such large surface areas for the intake and outflow to and from the filtering medium, as opposed to allowing the water to flow lengthwise through the locus of the filtering medium, the pressure drop across the filtering medium is minimized, and an adequate flow rate is thus maintained. It is noted, in particular, that the intake and outflow surfaces defined by baffles 212 and 214 parallel the largest sides of the filter case, while the direction of flow across the filter is across the smallest dimension of the filter case (front to rear), further reduced by the spacing of baffles 212 and 214 from walls 204 and 206.

The filtering medium can be of any suitable form, well known in the art, but will typically comprise particulate activated charcoal, and preferably also a suitable resin. The filtering medium can be emplaced and removed through the upper end of main body 120, between baffles 212 and 214, which are not interconnected at their upper ends, when the cover 118 is removed. For convenience, the filtering medium may be provided in disposable packages wherein a premeasured volume of filtering medium is prepackaged in a porous envelope 119, e.g. of a non-woven fibrous material, a very fine mesh woven fabric, or the like. The envelope 119 is shaped to fit between baffles 212 and 214. This envelope can then be placed in the filter case as needed, and removed and disposed of when spent, without the need for measuring or any direct handling of the filtering medium. The envelope is preferably biodegradable. The use of this envelope may also tend to inhibit dust from the filtering medium from entering the water stream or the outer parts of the filter case and permits the holes in baffles 212 and 214 to be large.

Alternatively, the entire filter case 118, 120 may be disposed and replaced by a similar case, pre-packed with fresh filtering medium. If this is to be done, it may be desirable to reduce the size of the holes in baffles 212, 214 or to line those baffles with a fabric to inhibit pieces of the filtering medium from entering the water stream exiting the filter.

In either case, i.e. whether or not the entire case is disposable, the filtering medium is considered removably disposed in the housing means for purposes of this specification.

The cover 118 has internal walls 224 and 225 which partially define two mutually isolated transition paths. The first such path leads from the tubular formation 122 to the lateral space 218 on the intake side of the filtering medium 222. The other transition path leads from the space 216 on the outflow side of the filtering medium 222 to the tubular formation 124, which defines the filter outlet. These transition paths allow the use of small, annular inlet and outlet, conveniently located side by side at the top of the filter case, while nevertheless allowing for the relatively large surface areas of the intake and outflow surfaces, as described above.

Figure 21:
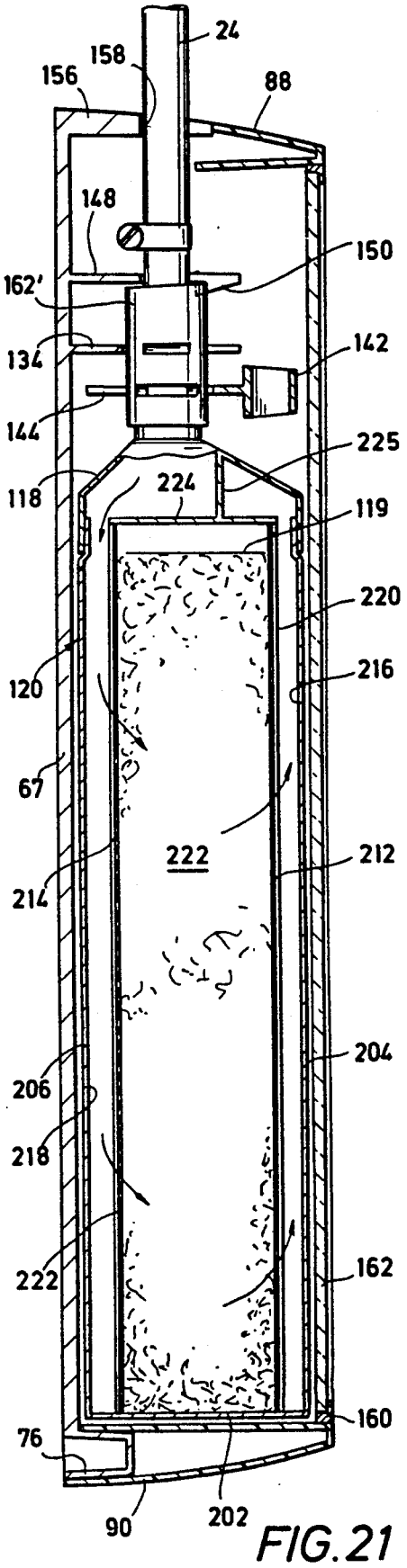
FIG. 21 is a cross-sectional view of the filter taken on the line 21—21 of FIG. 16.

Referring to FIG. 21, it can be appreciated that, because of the arrangement of the horizontal wall 224 of cover 118 abutting the upper ends of baffles 212 and 214, and bottom wall 202 of main body 120 abutting their lower ends, once the water has entered space 218, it cannot bypass the filtering medium 222, but must flow therethrough.

Referring to FIGS. 25 and 26, there is shown a second embodiment of filter case and filter. In this embodiment, the filter case has a cylindrical main body 328 and a cover 330. The cover 330 defines a pair of upstanding tubular formations 332 and 334 which serve as the inlet and outlet, respectively, of the filter case. It should be understood that these tubular formations can be connected to the lines 22 and 24 by quick disconnect couplers, as described above in connection with the first embodiment. However, for simplicity of illustration, and since the quick disconnect couplers do not affect the other unique features of this embodiment, a simplified diagramatic connection has been shown in FIG. 25. Also, although the formations 332 and 334 are actually disposed side by side laterally, for alignment with lines 22 and 24, their orientation has been shown rotated 90° in FIG. 25, so that they can be shown in a single figure along with the way the filter case is received in the remainder of the housing.

A tapered tubular internal porous baffle 336, which narrows from its upper end to its lower end, is formed integrally with, or rigidly affixed to, the upper end of main body 328 and extends downwardly thereinto, stopping short of the bottom wall 338. At its lower end, baffle 336 adjoins the outer edge of a solid annular member 340. Also adjoining annular member 340, radially inwardly of baffle 336, is a similar, but smaller, porous baffle 342 which extends back upwardly to a point adjacent the upper edge of main body 328. It can be seen that the two parallel baffles 336 and 342 define a tapered annular locus therebetween, and the filtering medium 334 is received in this locus.

A solid tube 346, formed integrally with cover 330, has its upper end communicating with outlet formation 334, and extends downwardly therefrom until its lower end is received in the central bore of annular member 340. Inlet formation 332 communicates freely with the area internal to baffle 342. Thus, baffle 342 defines a large surface area intake surface for the filtering medium 334.

Because tube 346 and annular member 340 are solid, water flowing into the interior of baffle 342 must pass through the filtering medium 334 and out through baffle 336, which forms the outflow surface for the filtering medium. Then, the water can flow along the bottom of the filter case, and up through tube 346 and outlet 334.

As in the preceding embodiment, this arrangement allows for relatively small, adjacent, annular inlet and outlet formations, while still providing large intake and outflow surfaces for the filter itself and a small distance for flow across the filtering medium.

As in the preceding embodiment, the filtering medium may comprise activated charcoal and a suitable resin, and may be prepackaged in tubular porous envelopes sized and shaped to fit removably in the space between baffles 336 and 342. Alternatively, the entire filter case may be disposable.

In order to change the filtering medium, the door 160 is opened, the formations 332 and 334 are disconnected from lines 22 and 24, and the entire filter case 328 and 330 is removed from the filter compartment 100. If the case is to be re-used, the cover 330 is removed from the main body 328, which opens the upper end of the space between baffles 336 and 342, so that the filtering medium can be removed and replaced. Then, the cover 330 is replaced, taking care to fit the lower end of tube 346 into the hole in annular member 340. Then, the filter case is returned to the filter compartment, reconnected to lines 22 and 24, and the door 160 closed.

Figure 17:
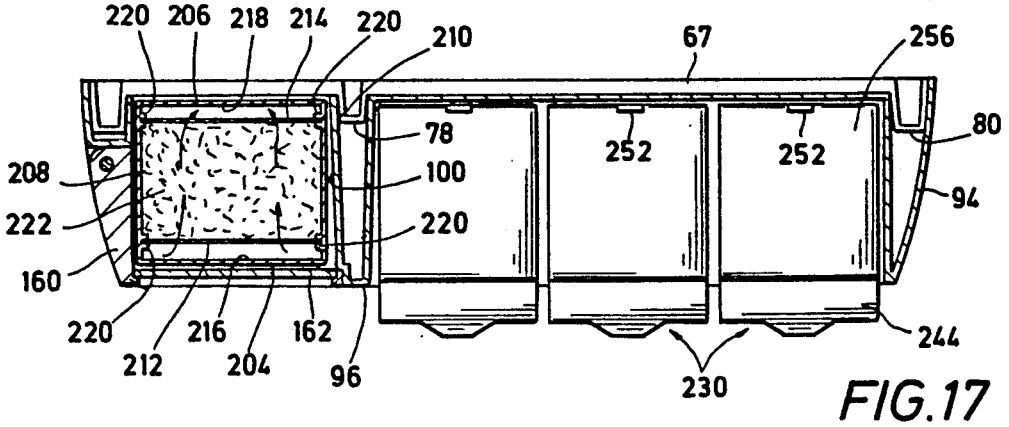
FIG. 17 is a view taken on the line 17—17 of FIG. 16.

Referring now to FIGS. 16, 17 and 22, the right-hand or holder portion of the housing will be described, in conjunction with cosmetic containers designed to specially cooperate therewith. Wall 96 of the front portion 68 of the housing divides the filter compartment 100 on the left from the holder portion on the right. The holder portion is in turn subdivided by wall 98 into upper and lower compartments. The lower wall 90 of the front portion of the housing defines a first shelf, for the lower compartment, and this shelf supports the special containers, to be described below. Wall 98 serves as a second shelf, above the first compartment, and thereby defines a second compartment in which may be kept smaller items, such as jars, razor, etc.

In the embodiment shown, three containers 230 are disposed in the first or lower compartment. These containers are in the form of vertically elongate bottles having push-type dispenser means. The bottles 230 and their dispenser means are designed to make it particularly easy for a user to dispense cosmetics or the like therefrom while showering, and without removing the bottles from their compartment, or even changing their positions.

As shown in FIG. 22, each bottle 230 is enlarged adjacent its upper end so that the upper portion thereof protrudes forwardly, as shown at 232. The dispensing means is in the form of a push button type pump having an uptake tube 234, a pump body 236, of conventional construction well known in the art, and a push-type operator 238 having the dispensing port or spout 240. Tube 234 has a corrugated, flexible section 242 so that it can be angled upwardly and forwardly through bottle 230. The push button 238 is located outside the protruding portion 232 of the bottle 230, and its push surface 234 is angled downwardly and forwardly.

The above configuration makes it particularly convenient for a person to dispense liquids from container 230 without moving that container with respect to the holder portion of the housing. Specifically, the protruding or projecting configuration of the upper portion 232 of the bottle places the operator 238 clear of the second shelf 98 and the lower portion of the bottle, and provides a sort of recessed area 246 below the dispensing port 240, where the user can place one hand to receive liquids being dispensed from port 240. The inclination of surface 244 makes it especially convenient for the user to push downwardly and rearwardly, as required by the angle of the pump 236, and it has been found that pushing in this direction is actually more ergonomically comfortable than pushing in a straight horizontal or straight vertical direction.

The bottles 230 and the holder portion of the housing are also provided with interengaging formations which not only help to hold the bottles in place in use, but also allow the bottles to be refilled, without removing them from the housing, even though second shelf 98 lies quite close to the tops of the bottles 230.

The upper run of lower wall 90 of the housing is provided with a respective slit 248 for each of the three bottles. Each bottle has a pivot projection 250 extending downwardly from the front of its lower surface and into a respective one of the slits 248. A tab 252 projects upwardly from the rear of the top of each container 230 and is aligned with a front-to-rear slot 254 in the lower run of wall 98. The slot 254 is closed at its front end.

In the normal resting position, as shown in solid lines in FIG. 22, the tab 252 is clear of the slot 254. When it is desired to refill the bottle 230, the bottle can be pivoted about projection 250, by moving its upper end forward, as shown in phantom lines in FIG. 20. This causes the tab 252 to move upwardly and forwardly, so that it moves into the slot 254, and finally abuts the closed front end of slot 254 to limit the pivotal movement of bottle 230 to the position shown in phantom lines, and the bottle can rest in this position without falling out of the housing. This substantially clears a cover 256 of the bottle 230 from the second shelf formed by housing wall 98. The cover 256 is hinged at the rear, so that it can then be opened, the bottle refilled, and then the bottle returned to its resting or solid line position.

Because the tab 252 lies well below the slot 254 in the resting position, and because strip 82 of rear housing portion 66 has a hole 253 aligned with the rear of slot 254, if it should be desired to completely remove the bottle 230 from the housing, e.g. to clean it, this can be done by lifting straight up on the bottle. Enough clearance is provided above tab 252 so that it can move into the rear part of slot 254 and hole 253 to allow such movement, whereby pivot projection 250 can be freed from slit 248. Then, the lower portion of the bottle 230 can be moved outwardly and downwardly, removing tab 252 from slot 254. This procedure is reversed to replace the bottle 230.

FIG. 23 shows a different form of container having a main body 258. This main body has flexible side walls, the forward one of which bulges outwardly as indicated at 259. The lower end of the main body tapers downwardly and inwardly to a downwardly opening central tubular mouth 260. A base member 264 has a frustoconical upper wall 266 with a central aperture 268. The frustoconical wall 266 is tapered to mate with the bottom of main body 258, and is bonded thereto. The tubular mouth 260 extends through aperture 268 and into the vertical portion of an L-shaped flowway 270 defined in the base 264. The L-shaped flowway 260 extends downwardly and then forwardly through the base member 264. The forward end is closed, as indicated at 280, but a further downward leg, forming an open spout or dispensing port 272, intersects the forwardly extending portion of the flowway upstream of the closure 280 and forms a further extension of the flowway. Mouth 260 and flowway 270, 272 jointly serve as the outlet of the container.

Upstream of spout 272, an annular seat 274 is formed in the flowway. A check valve is associated with this seat. In particular, a ball 276 is located downstream of the seat and yieldably urged against the seat by a spring 278. When the bottle is pushed, as indicated by the arrow A, the pressure of the fluid being expelled from the bottle into the flowway will urge the ball away from the seat so that the fluid can be released through the spout 272, whereafter, the spring 278 returns the ball 276 to a seated position to prevent leakage of the contents of the container 258 when not being actively expelled.

The upper end of main body 258 of the container also has a downwardly and inwardly tapered wall 263, and a short tubular seat 265 extends downwardly from the center of wall 263. A removable cover 261 has a friction fit on an upstanding rim 267 of main body 258. A tubular extension 262 extends downwardly from the center of cover 261 and fits into seat 265. Extension 262 contains a conventional flapper-type check valve, well known in the art, to allow for air intake to replace the fluid which is expelled from the bottom of the container when the flexible wall is pushed as indicated by the arrow A.

The container and holder are provided with interengaging formations, similar to those of the embodiment of FIG. 22, which allow the container to be tilted forwardly until its upper end is sufficiently clear of shelf 98 for cover 261 to be removed and the contents of the container to be replenished. Briefly, the upper run of the lower wall 90 of the housing is again provided with a slit 248 which receives the pivot projection 250*a* on the bottom of the base portion of the container. The tab 252*a* projects upwardly from the rear of the top of the main body 258 of the container and is aligned with the front-to-rear slot 254 in the lower run of wall 98. Again, strip 82 of the rear housing portion 66 has the hole 253 aligned with the rear of slot 254 to allow enough clearance for upward movement of the entire container so as to remove projection 250*a* from slit 248.

Referring now to FIG. 24, there is shown a modification wherein conventional bottles of various sizes and shapes can be accommodated. A conventional bottle 294, such as the bottle in which a given cosmetic was purchased, rests on the first shelf defined by wall 90.

Bottle 294 may be one of several, and the others may be of different sizes and/or shapes. The housing has been modified by the provision of a wall 302 upstanding from the front of wall 90. Wall 302 is tall enough to retain bottle 294 in place, but not so tall as to interfere with removal of bottle 294 from the housing.

A conventional push-type pump assembly has a pump casing 286, an uptake tube 288 extending into bottle 294, and a push-type operator 290 defining dispensing spout 292.

The screw cap of the bottle 294 has been removed, and a resilient bung ring 296, having a frustoconical external configuration, expanding upwardly, is provided to seal between the mouth 298 of bottle 294 and the uptake tube 288. Bung 296 has a central bore 300 which slidably receives and seals against tube 288. Because of its frustoconical shape, bung 296 can seal against bottle mouths of various diameters, while the slidability of bung 296 alone tube 288 accommodates bottles of various heights.

In more elaborate versions of this general embodiment, means may be provided to support pump casing 286, and similar casings for other bottles, with respect to the housing, independently of the bottles, and preferably at the same height. Also, wall 302 might be eliminated and a full cover or door provided.

Figure 27:
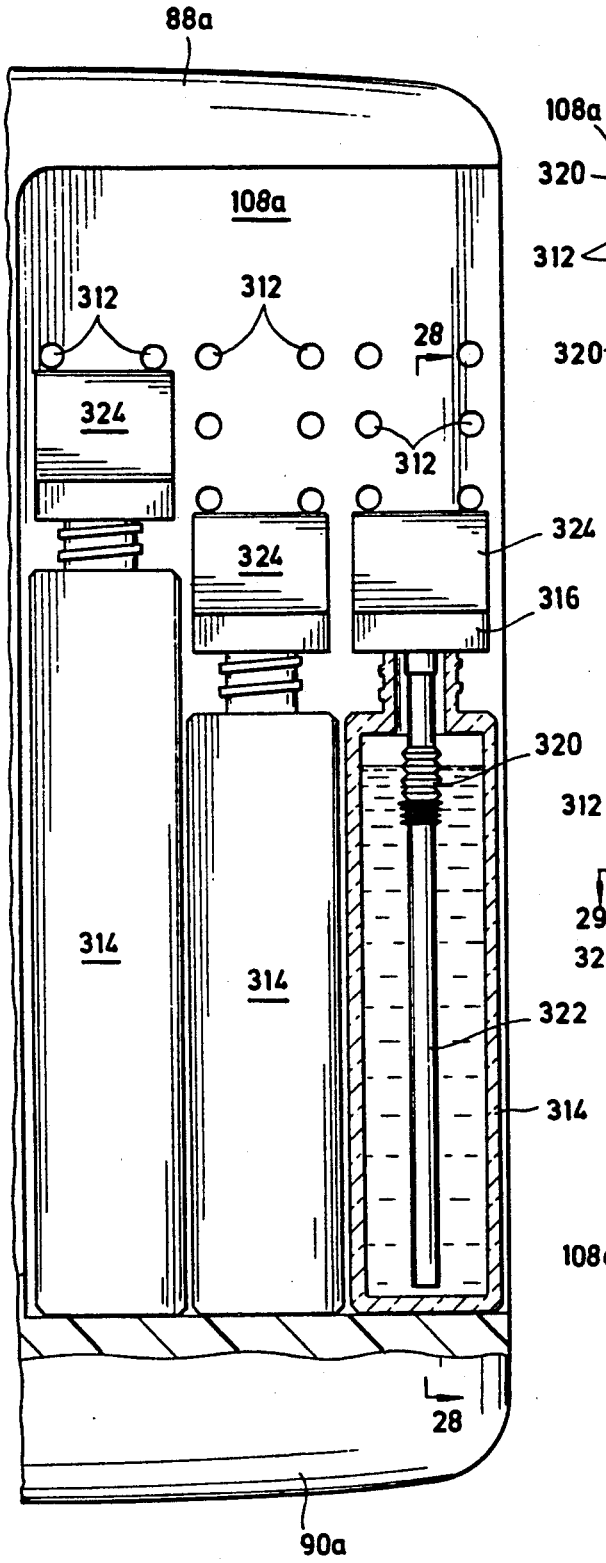
FIG. 27 is a front elevation view of the holder portion of another embodiment of housing and cosmetic container.
Figure 29:
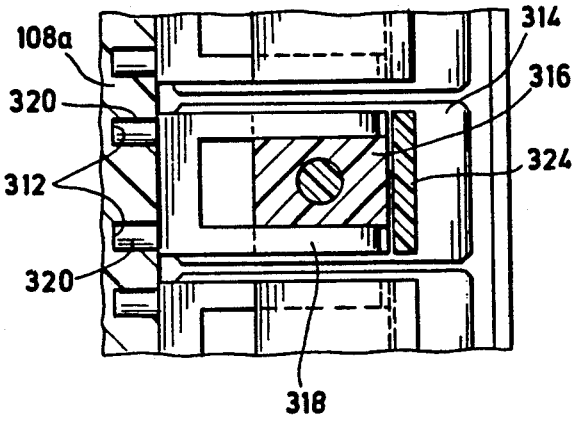
FIG. 29 is a view taken on the line 29—29 of FIG. 28.
Figure 28:
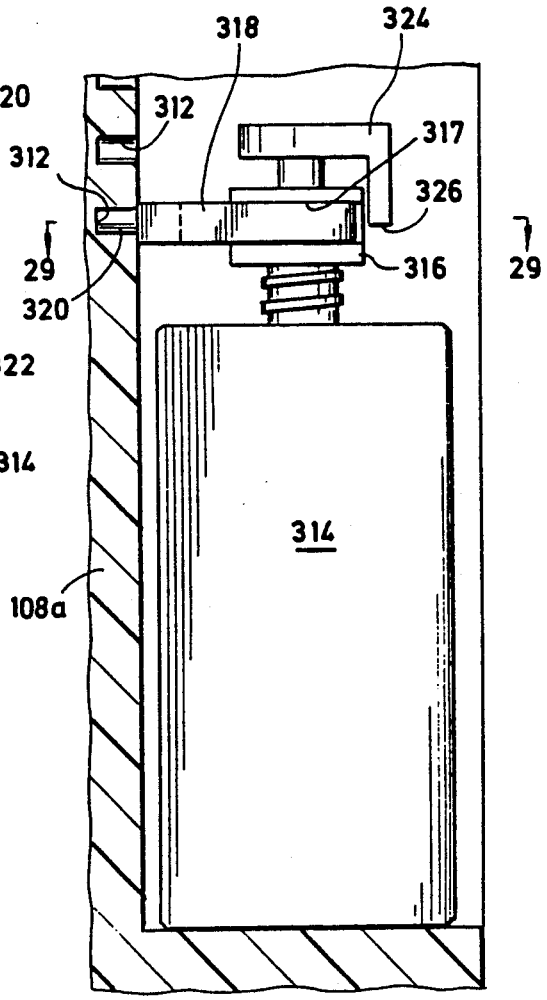
FIG. 28 is a view taken on the line 28—28 of FIG. 27.

FIGS. 27, 28 and 29 show still another modification for accommodating commercial bottles of different sizes. Once again, the bottles rest on the first shelf. Their pump means are supported on the rear wall of the first compartment. The pump means can be adjustably supported at various heights, so that the need for the sealing bung can be eliminated.

In the modification of FIGS. 27–29, the walls 90*a*, 88*a* and 108*a* of the front portion of the housing have been thickened, and walls 94 and 98 have been eliminated, so that the holder portion of the housing consists of a single open-sided holder compartment.

The rear wall 108*a* of this compartment has several sets of holes 312, arranged in side-by-side pairs, with several series of such pairs progressing lengthwise or vertically along the wall 108*a*. Various bottles 314, which may be of different heights, rest on the shelf formed by wall 90*a*. Each has a respective push-type dispenser pump which is more or less conventional except that the pump body 316 has lateral grooves 317 receiving the arms of a yoke 317. Projecting rearwardly from the yoke 317 are a pair of pins 320 sized and spaced to fit in a pair of the holes 312. Moving pins 320 to different pairs of holes 312 provide for gross adjustment to the height of the respective bottle 314, and further fine adjustments can be accommodated by a corrugated section 320 of the uptake tube 322. The pump also includes a push button 324 defining a dispensing spout or port 326.

Numerous modifications of the preferred embodiments described above will suggest themselves to those of skill in the art. Various of the features disclosed hereinabove can be utilized independently of one another, and/or in different combinations from those shown. Accordingly, it is intended that the scope of the invention be limited only by the claims which follow.

What is claimed is:

1. A water filter assembly for use with a shower bath, comprising:

housing means having inlet and outlet means;

filter means mounted in the housing means in communication with the inlet and outlet means so that water flowing into the housing means through the inlet means will pass through the filter means and out the outlet means;

a bypass adapter having:

means defining a source port opening through a rear surface of the bypass adapter, the means being adapted for connection to a water source pipe to communicate the water source pipe with the source port, means defining upstream and downstream bypass parts opening through a lower surface of the bypass adapter, the means defining the bypass ports being adapted for connection to the housing means to communicate the inlet and outlet means, respectively, with the upstream and downstream bypass ports, means defining a head port opening through a front surface of the bypass adapter, the means defining the head port being adapted for connection to a shower head to communicate the head port with the interior of the shower head, and the adapter having internal passage means communicating the source port with the upstream port and communicating the downstream port with the head port.

2. The assembly of claim 1 wherein the internal passage means include a first passage between the source port and the upstream bypass port and a second passage between the downstream bypass port and the head port; the bypass adapter further comprising bypass valve means between the first and second passages and movable between a bypass position, blocking the first and second passages from direct communication with each other, and a direct connection position, communicating the first and second passages with each other and blocking the source port from communication with the upstream bypass port.

3. The assembly of claim 2 wherein the bypass valve means is further movable to a closed position blocking the source port from communication with the other ports of the bypass adapter.

4. The assembly of claim 3 wherein the first passage has a front-to-rear section extending from the source port and a vertical section extending to the upstream bypass port; the second passage has a vertical section extending from the downstream bypass port and a front-to-rear section extending to the head port; one of the passages has a laterally extending section between its vertical section and its front to rear section and intersecting the other of the passages: and the bypass valve means is disposed in the laterally extending section of the one passage.

5. The assembly of claim 4 further comprising actuator means exposed on the front of the bypass adapter and operatively connected to the bypass valve means for selectively moving the bypass valve means to its various positions.

6. A water filter assembly for use with a shower bath, comprising:

housing means having inlet and outlet means and comprising a holder portion adapted to receive containers;

filter means mounted in the housing means in communication with the inlet and outlet means so that water flowing into the housing means through the inlet means will pass through the filter means and out the outlet means;

a bypass adapter having:

means defining a source port, the means being adapted for connection to a water source pipe to communicate the water source pipe with the source port, means defining upstream and downstream bypass ports, the means defining the bypass ports being adapted for connection to the housing means to communicate the inlet and outlet means, respectively, with the upstream and downstream bypass ports, means defining a head port, the means defining the head port being adapted for connection to a shower head to communicate the head port with the interior of the shower head, and the adapter having internal passage means communicating the source port with the upstream port and communicating the downstream port with the head port.

7. The assembly of claim 6 wherein the filter means comprises a disposable filtering medium removably disposed in the housing means.

8. The assembly of claim 7 wherein the housing means is positioned below the bypass adapter.

9. The assembly of claim 6 further comprising a mirror mounted on the exterior of the housing means closely adjacent the filter means.

10. The assembly of claim 6 further comprising a plurality of containers mounted in the holder portion, and push-type dispenser means associated with the containers and operable from the front of the housing means.

11. The assembly of claim 10 wherein each of the push-type dispenser means comprises a pump having an uptake tube extending upwardly and forwardly through a respective one of the containers, and a push-type operator means, with a dispensing port therein, at the upper forward end of the pump, outside the respective container.

12. The assembly of claim 11 wherein each of the containers has a forwardly projecting upper portion, the pump extending through the forwardly projecting portion to position the operator means adjacent the forwardly projecting portion with the dispensing port spaced forwardly of the lower portion of the container.

13. The assembly of claim 12 wherein the operator means has a push surface angled forwardly and downwardly.

14. The assembly of claim 10 wherein the holder portion of the housing means comprises a first shelf underlying the containers and a second shelf above the containers.

15. The assembly of claim 14 wherein each of the containers has an upper cover, the container and the housing having interengaging formations permitting the upper end of the container to be tilted forward so that the cover is sufficiently clear of the second shelf to be opened, but limiting such tilting movement.

16. The assembly of claim 15 wherein the interengaging formations comprise:

pivot means adjacent the lower front of the container, including a pivot projection on one of (a) the bottom of the container or (b) the first shelf, the pivot projection extending into a receptacle on the other of (a) the bottom of the container or (b) the first shelf; and retainer means adjacent the top of the container including a tab on one of (c) the top of the container or (d) the underside of the second shelf, the tab being aligned with and receivable in a front-to-rear slot, closed at the front, in the other of (c) the top of the container or (d) the underside of the second shelf.

17. The assembly of claim 16 wherein the pivot projection and the tab are disposed on the container.

18. The assembly of claim 16 wherein, in an untilted position of the container, the tab is at least partially clear of the slot, and wherein there is sufficient clearance between the top of the container and the housing means to permit the container to be raised from the first shelf and the pivot projection freed from its receptacle to remove the container from the housing.

19. The assembly of claim 10 wherein each of the containers is flexible and has an outlet adjacent its lower end; and further comprising a respective dispensing check valve associated with each of the outlets permitting fluid flow outwardly against a resilient bias.

20. The assembly of claim 19 wherein the container also has an air intake check valve adjacent its upper end.

21. The assembly of claim 19 wherein the front of each of the containers is exposed at the front of the housing means.

22. The assembly of claim 10 wherein the push-type dispensing means comprises pump means each having a lower uptake tube disposed in a respective one of the containers and an upper pumping portion above the top of the respective container.

23. The assembly of claim 22 further comprising bung means for sealing between each uptake tube and the respective container mouth, the bung means being vertically adjustable along the length of the uptake tube.

24. The assembly of claim 22 wherein the housing means comprises a vertical rear wall of the holder portion, and means associated with the vertical wall and the upper pumping portions for selectively mounting the upper pumping portions at different heights.

25. A water filter assembly for use with a shower bath, comprising:

housing means having inlet and outlet means and comprising a main housing defining a filter compartment, the housing means further comprising a filter case removably mounted in the filter compartment and defining the inlet and outlet means;

a disposable filtering medium removably disposed in the filter case in communication with the inlet and outlet means so that water flowing into the housing means through the inlet means will pass through the filter means and out the outlet means;

a bypass adapter having:

means defining a source port, the means being adapted for connection to a water source pipe to communicate the water source pipe with the source port, means defining upstream and downstream bypass ports, the means defining the bypass ports being adapted for connection to the housing means to communicate the inlet and outlet means, respectively, with the upstream and downstream bypass ports, means defining a head port, the means defining the head port being adapted for connection to a shower head to communicate the head port with the interior of the shower head, and the adapter having internal passage means communicating the source port with the upstream port and communicating the downstream port with the head port;

and connector means releasably communicating the means defining the bypass ports with the inlet and outlet means, respectively.

26. The assembly of claim 25 wherein the connector means comprises quick disconnect-type coupler means.

27. The assembly of claim 26 wherein the quick disconnect means so communicate by means of elongate tubular lines extending from respective bypass ports to the quick disconnect means.

28. The assembly of claim 26 further comprising bracket means on the main housing mounting the quick disconnect-type coupler means.

29. The assembly of claim 26 wherein there are two quick disconnect type couplers, each connecting a respective one of the bypass ports to the inlet means or the outlet means, respectively: each of the quick disconnect type couplers comprising an outer annular body and an inner annular body received in the outer annular body, one of the bodies being connected to the bypass adapter and the other of the bodies being connected to the filter case.

30. The assembly of claim 29 wherein the quick disconnect type coupler means further comprises removable detent means, accessible from the outside of the bodies, and interengaging the two bodies of each coupler to retain the inner body in the outer body.

31. The assembly of claim 30 wherein the detent means for both couplers are on a common carrier member.

32. The assembly of claim 29 wherein each of the couplers is of a conventional ball detent type releasable by longitudinal movement of a retainer member with respect to the outer body; and further comprising a release member movably mounted on the housing and engaging the retainer means of both of the couplers for simultaneously longitudinally moving the retainer members and thereby releasing the couplers.

33. The assembly of claim 25 wherein the inner case defines a first transition path communicating the inlet means with an intake surface of the filtering medium, the intake surface being substantially greater than the cross-sectional flow area of the inlet means, and a second transition path, isolated from the first path, communicating an outflow surface of the filtering medium with the outlet means, the outflow surface being substantially greater than the cross-sectional flow area of the outlet means.

34. The assembly of claim 33 wherein the inlet and outlet means comprise respective annular formations adjacent each other on the top of the inner case; the inner case having a pair of opposed lateral walls and two porous inner baffles, each parallel to and spaced inwardly from a respective one of the lateral walls to define a respective lateral space, the two baffles bounding the intake and out flow surfaces respectively and containing the filtering medium therebetween, each of the transition paths including a respective one of the lateral spaces.

35. The assembly of claim 34 wherein the maximum dimension of the inner case between the inner baffles is substantially less than the surface area of the baffles.

36. The assembly of claim 34 wherein the filtering means further comprises a disposable water-permeable envelope with the filtering medium therein, removably disposed in the filter case.

37. The assembly of claim 33 wherein the filtering medium is contained by porous wall means in a tubular locus within the filter case one of the transition paths including the interior of the tubular locus, and the other of the transition paths including the exterior of the tubular locus.

38. The assembly of claim 37 including an isolation tube extending lengthwise through the tubular locus and forming a part of the other transition path to communicate the respective inlet or outlet with the exterior of the tubular locus.

39. The assembly of claim 25 wherein the filter case, and its connection to the connector means, are sealed and adapted to hold internal pressures in excess of ambient.

40. The assembly of claim 25 wherein said main housing has a rear portion adapted for mounting on the wall of a shower stall, and a front portion removably attachable to the rear portion, the front portion having front-to-rear walls defining a filter compartment and at least one holder compartment, the front portion including a door across the filter compartment.

41. The assembly of claim 40 wherein the front portion is open at the rear of the filter compartment.

42. The assembly of claim 41 further comprising a mirror on the outside of the door.

43. The assembly of claim 40 wherein the front portion has a transverse wall closing the rear of the holder compartment.

44. The assembly of claim 43 wherein the holder compartment is open at the front.

45. A dispensing container comprising:

a generally vertically oriented bottle having a projecting portion near its upper end projecting in a forward direction;

a push-type dispenser comprising a pump having an uptake tube extending upwardly and forwardly through the bottle, and a push-type operator, with a dispensing port therein, disposed outside and adjacent to the projecting portion of the bottle with the dispensing port spaced forwardly of a lower portion of the bottle located below the projecting portion;

housing means adapted for mounting in a shower stall below a shower head and having a holder portion supporting the container with its forward portion facing into the shower stall and its operator exposed;

a filter in the housing means; and bypass means for diverting water from a point upstream of the shower head, through the filter, and back to the shower head.

46. A dispensing container comprising:

a generally vertically oriented, flexible-walled bottle having an upper cover and an outlet adjacent its lower end;

a dispensing check valve associated with the outlet permitting fluid flow outwardly against a resilient bias;

an intake check valve carried by the upper cover of the bottle;

housing means includinga holder removably holding the bottle and bracing the bottle against pushing of the flexible wall, and a filter in the housing means; and bypass means for diverting water from a point upstream of a shower head, through the filter means, and back to the shower head.

47. A water filter assembly for use with a shower bath, comprising:

housing means having inlet and outlet means;

filter means mounted in the housing means in communication with the inlet and outlet means so that water flowing into the housing means through the inlet means will pass through the filter means and out the outlet means;

a bypass adapter having:

means defining a source port, the means being adapted for connection to a water source pipe to communicate the water source pipe with the source port, means defining upstream and downstream bypass ports, the means defining the bypass ports being adapted for connection to the housing means to communicate the inlet and outlet means, respectively, with the upstream and downstream bypass ports, means defining a head port, the means defining the head port being adapted for connection to a shower head to communicate the head port with the interior of the shower head, and the adapter having internal passage means including a first passage between the source port and the upstream bypass port and a second passage between the downstream bypass port and the head port;

the bypass adapter further comprising bypass valve means between the first and second passages and movable between a bypass position, blocking the first and second passages from direct communication with each other, and a direct connection position, communicating the first and second passages with each other and blocking the source port from communication with the upstream bypass port.

48. A water filter assembly for use with a shower bath, comprising:

housing means having inlet and outlet means;

elongate tubular lines extending upwardly from the inlet and outlet means;

filter means mounted in the housing means in communication with the inlet and outlet means so that water flowing into the housing means through the inlet means will pass through the filter means and out the outlet means;

a bypass adapter, spaced substantially above the housing means, and having:

means defining a source port, the means being adapted for connection to a water source pipe to communicate the water source pipe with the source port, means defining upstream and downstream bypass ports, the means defining the bypass ports being connected to the elongate tubular lines to communicate the inlet and outlet means, respectively, with the upstream and downstream bypass ports, means defining a head port, the means defining the head port being adapted for connection to a shower head to communicate the head port with the interior of the shower head, and the adapter having internal passage means communicating the source port with the upstream port and communicating the downstream port with the head port.

49. A water filter assembly for use with a shower bath, comprising:

housing means having inlet and outlet means;

filter means mounted in the housing means in communication with the inlet and outlet means so that water flowing into the housing means through the inlet means will pass through the filter means and out the outlet means, the filter means comprising a removable, disposable filtering medium;

a bypass adapter having:

means defining a source port, the means being adapted for connection to a water source pipe to communicate the water source pipe with the source port, means defining upstream and downstream bypass ports, the means defining the bypass ports being adapted for connection to the housing means to communicate the inlet and outlet means, respectively, with the upstream and downstream bypass ports, means defining a head port, the means defining the head port being adapted for connection to a shower head to communicate the head port with the interior of the shower head, and the adapter having internal passage means communicating the source port with the upstream port and communicating the downstream port with the head port;

elongate tubular lines extending downwardly from the respective bypass ports; and quick disconnect means releasably connecting the inlet and outlet means, respectively, with the tubular lines.

* * * * *

UNITED STATES PATENT AND TRADEMARK OFFICE

CERTIFICATE OF CORRECTION

PATENT NO. : 5,192,427

DATED : March 9, 1993

INVENTOR(S) : Douglas R. Eger, et al.

It is certified that error appears in the above-identified patent and that said Letters Patent is hereby corrected as shown below:

In Column 16, Line 11, change "parts" to --ports--.

In Column 19, Line 16, change "respectively:" to --respectively;--.

In Column 19, Line 68, change "case" to --case;--.

Signed and Sealed this

Thirtieth Day of November, 1993

Bruce Lehman

*Attest:*

BRUCE LEHMAN

*Attesting Officer*

*Commissioner of Patents and Trademarks*